US007546051B2

(12) United States Patent
Sone et al.

(10) Patent No.: US 7,546,051 B2
(45) Date of Patent: Jun. 9, 2009

(54) FIXING APPARATUS AND IMAGE PROCESSING APPARATUS

(75) Inventors: Toshihiro Sone, Yokohama (JP); Osamu Takagi, Chofu (JP); Satoshi Kinouchi, Tokyo (JP); Yoshinori Tsueda, Fuji (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 253 days.

(21) Appl. No.: 11/736,076

(22) Filed: Apr. 17, 2007

(65) Prior Publication Data

US 2008/0260406 A1 Oct. 23, 2008

(51) Int. Cl.
*G03G 15/20* (2006.01)

(52) U.S. Cl. ..... 399/69; 399/328

(58) Field of Classification Search ..... 399/38, 399/67, 69, 122, 320, 328; 219/216
See application file for complete search history.

(56) References Cited

U.S. PATENT DOCUMENTS 7,079,781 B2 * 7/2006 Suzuki et al. ..... 399/45
7,245,866 B2 * 7/2007 Frohlich ..... 399/341
7,477,855 B2 * 1/2009 Chae et al. ..... 399/33

FOREIGN PATENT DOCUMENTS

| | | |
|---|---|---|
| JP | 2000-259034 | 9/2000 |
| JP | 2001-265156 | 9/2001 |
| JP | 2003-066761 | 3/2003 |

* cited by examiner

*Primary Examiner*—Hoan H Tran
(74) *Attorney, Agent, or Firm*—Turocy & Watson, LLP

(57) ABSTRACT

A fixing apparatus according to an embodiment of the invention includes a heating roller for providing heat to a developer holding medium holding a developer image, a pressurizing roller which comes in contact with the heating roller, a heater having heating members for heating the heating roller, a non-contact temperature detector which includes a non-contact temperature detection element for detecting a first temperature of the heating roller in an area between a position heated by the heater and a position to contact the pressurizing roller with heating the heater, from detection positions in the longitudinal direction of the heating roller, and a detection range adjustment member which is placed between the non-contact temperature detection element and the heating roller, and has openings to set a detection range wider for far detection positions, compared with a range for near detection positions.

20 Claims, 10 Drawing Sheets

(℃)

| | | | A5 | A4 | A3 | B5 | B4 |
|---|---|---|---|---|---|---|---|
| Ordinary paper | Monochrome | Single-sided copy | 160 | 160 | 165 | 160 | 160 |
| | | Double-sided copy | 150 | 153 | 155 | 150 | 153 |
| | Color | Single-sided copy | 165 | 170 | 175 | 168 | 170 |
| | | Double-sided copy | 160 | 165 | 168 | 160 | 165 |
| Cardboard | Monochrome | Single-sided copy | 165 | 170 | 175 | 168 | 170 |
| | | Double-sided copy | 160 | 163 | 165 | 160 | 163 |
| | Color | Single-sided copy | 172 | 175 | 182 | 172 | 175 |
| | | Double-sided copy | 165 | 170 | 175 | 168 | 170 |
| Thin paper | Monochrome | Single-sided copy | 148 | 150 | 153 | 148 | 150 |
| | | Double-sided copy | 145 | 148 | 150 | 145 | 148 |
| | Color | Single-sided copy | 150 | 152 | 155 | 150 | 152 |
| | | Double-sided copy | 148 | 150 | 153 | 148 | 150 |
| OHP | Monochrome | Single-sided copy | 163 | 165 | 170 | 165 | 168 |
| | Color | Single-sided copy | 168 | 170 | 175 | 170 | 173 |

FIG. 4

(℃)

| | | | A5 | A4 | A3 | B5 | B4 |
|---|---|---|---|---|---|---|---|
| Ordinary paper | Monochrome | Single-sided copy | 110 | 110 | 120 | 110 | 115 |
| | | Double-sided copy | 102 | 105 | 108 | 102 | 105 |
| | Color | Single-sided copy | 110 | 117 | 127 | 118 | 122 |
| | | Double-sided copy | 102 | 105 | 108 | 102 | 105 |
| Cardboard | Monochrome | Single-sided copy | 112 | 117 | 122 | 115 | 120 |
| | | Double-sided copy | 103 | 105 | 110 | 105 | 109 |
| | Color | Single-sided copy | 122 | 128 | 132 | 122 | 128 |
| | | Double-sided copy | 115 | 117 | 120 | 117 | 120 |
| Thin paper | Monochrome | Single-sided copy | 102 | 105 | 109 | 105 | 109 |
| | | Double-sided copy | 100 | 102 | 105 | 102 | 100 |
| | Color | Single-sided copy | 100 | 102 | 105 | 102 | 105 |
| | | Double-sided copy | 100 | 100 | 102 | 100 | 100 |
| OHP | Monochrome | Single-sided copy | 112 | 115 | 117 | 112 | 115 |
| | Color | Single-sided copy | 113 | 117 | 120 | 115 | 120 |

FIG. 5

FIXING APPARATUS AND IMAGE PROCESSING APPARATUS

BACKGROUND OF THE INVENTION

1. Field of the Invention

The present invention relates to an image processing apparatus, such as a copier and printer for forming an image on a transfer member by using an electrophotographic process, and a fixing apparatus incorporated in an image processing apparatus and used to fix a developer to a transfer member.

2. Description of the Related Art

In a copier or a printer using an electronic process, it is known that a toner image formed on a photoconductive drum is transferred to a transfer member, fused in a fixing apparatus including a heating roller and a pressurizing roller, and fixed to a transfer member.

An image processing apparatus of recent years is applicable to various printing modes, such as full-color, cardboard and double-sided printing, and capable of printing at high speed. Large thermal capacity is required for full-color, cardboard and double-sided printing, compared with monochrome, ordinary paper and single-sided printing. However, a low-temperature offset occurs when a heating roller temperature is lower than a fixing temperature, and a high-temperature offset occurs when a heating roller temperature is higher than a fixing temperature. An image is not satisfactorily fixed in either case.

There is a known image processing apparatus as disclosed in Jpn. Pat. Appln. KOKAI Publication No. 2000-259034, for example. The apparatus is capable of exactly and stably controlling a surface temperature of a rotating fixing body, by detecting a surface temperature of a rotating fixing body with good responsivity by using a non-contact surface temperature detection means, and detecting a surface temperature at two more points in a rotating fixing body by one non-contact surface temperature detection means.

Jpn. Pat. Appln. KOKAI Publication No. 2000-066761 discloses a fixing apparatus characterized by non-contact measurement of temperatures of a heating roller or a pressurizing roller at two more points by one temperature sensor, in which paper-passing area and non-passing area of a transfer material are measured easily and exactly by one non-contact temperature sensor.

Further, Jpn. Pat. Appln. KOKAI Publication No. 2001-265156 discloses an apparatus realizing optimum temperature adjustment irrespectively of transfer material sizes, by providing a slit temperature sensor between a fixing roller and a non-contact surface temperature detection means as one body, adjusting minutely the distance from an area definition plate and temperature sensor to a fixing roller by an actuator according to sizes of transfer material passing through a fixing roller, and setting a temperature detection area of a temperature sensor.

BRIEF SUMMARY OF THE INVENTION

According to an aspect of the present invention, there is provided an image processing apparatus comprising:

an image holding unit which forms an electrostatic latent image;

a developing unit which provides a developer to the image holding unit, and changes the electrostatic latent image into a developer image;

a transfer unit which transfers the developer formed in the image holding unit to a developer holding medium;

a fixing unit apparatus including:

a heating roller for supplying heat to the developer holding medium holding the developer image;

a pressurizing roller which comes in contact with the heating roller;

a heater having heating members for heating the heating roller; and a non-contact temperature detector which detects a first temperature of the heating roller in an area between a position heated by the heater and a position to contact the pressurizing roller with heating the heater, and a second temperature of the pressurizing roller in an area near a part to contact the heating roller;

a reversing mechanism which reverses the developer holding medium ejected from the fixing unit, and returns the medium to the image holding unit so that the back side of the developer holding medium with the developer image fixed is faced to the image holding unit;

a memory which stores preset values of the first and second temperatures for a front side mode for fixing the developer image on one side, and preset values of the first and second temperatures for a back side mode for fixing the developer image on the other side of the developer holding medium reversed by the reversing mechanism, according to conditions of the developer holding medium; and a controller which heats the heating roller according to the back side mode, when an image is formed on the other side of the developer holding medium reversed by the reversing mechanism.

According to another aspect of the present invention, there is provided an image processing apparatus comprising:

an image holding means which forms an electrostatic latent image;

a developing means which provides a developer to the image holding means, and changes the electrostatic latent image into a developer image;

a transfer means which transfers the developer formed in the image holding means to a developer holding medium;

a fixing means including:

a supplying heat means for supplying heat to a developer holding medium holding a developer image;

a pressurizing means which comes in contact with the supplying heat means;

a heating means having heating members for heating the supplying heat means; and a non-contact temperature detection means which detects a first temperature of the supplying heat means in an area between a position heated by the heating means and a position to contact the pressurizing means with heating the heating means, and a second temperature of the pressurizing means in an area near a part to contact the supplying heat means;

a reversing means which reverses the developer holding medium ejected from the fixing means, and returns the medium to the image holding means so that the back side of the developer holding medium with the developer image fixed is faced to the image holding means;

a memory means which stores preset values of the first and second temperatures for a front side mode for fixing the developer image on one side, and preset values of the first and second temperatures for a back side mode for fixing the developer image on the other side of the developer holding medium reversed by the reversing means, according to conditions of the developer holding medium; and a control means which heats the supplying heat means according to the back side mode, when an image is formed on the other side of the developer holding medium reversed by the reversing means.

According to another aspect of the present invention, there is provided a fixing apparatus comprising:

a heating roller for providing heat to a developer holding medium holding a developer image;

a pressurizing roller which comes in contact with the heating roller;

a heater having heating members for heating the heating roller;

a non-contact temperature detector which includes a first non-contact temperature detection element for detecting a first temperature of the heating roller in an area between a position heated by the heater and a position to contact the pressurizing roller with heating the heater, from detection positions in the longitudinal direction of the heating roller; and a first detection range adjustment member which is placed between the first non-contact temperature detection element and the heating roller, and has openings to set a detection range wider for far detection positions, compared with a range for near detection positions.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 4 is an example of a table of preset values of fixing temperature applicable to the fixing apparatus shown in FIG. 2;

FIG. 5 is an example of a table of preset values of fixing temperature applicable to the fixing apparatus shown in FIG. 2;

DETAILED DESCRIPTION OF THE INVENTION

An example of an image processing apparatus according to an embodiment of the invention will be explained hereinafter with reference to the accompanying drawings.

Figure 1:
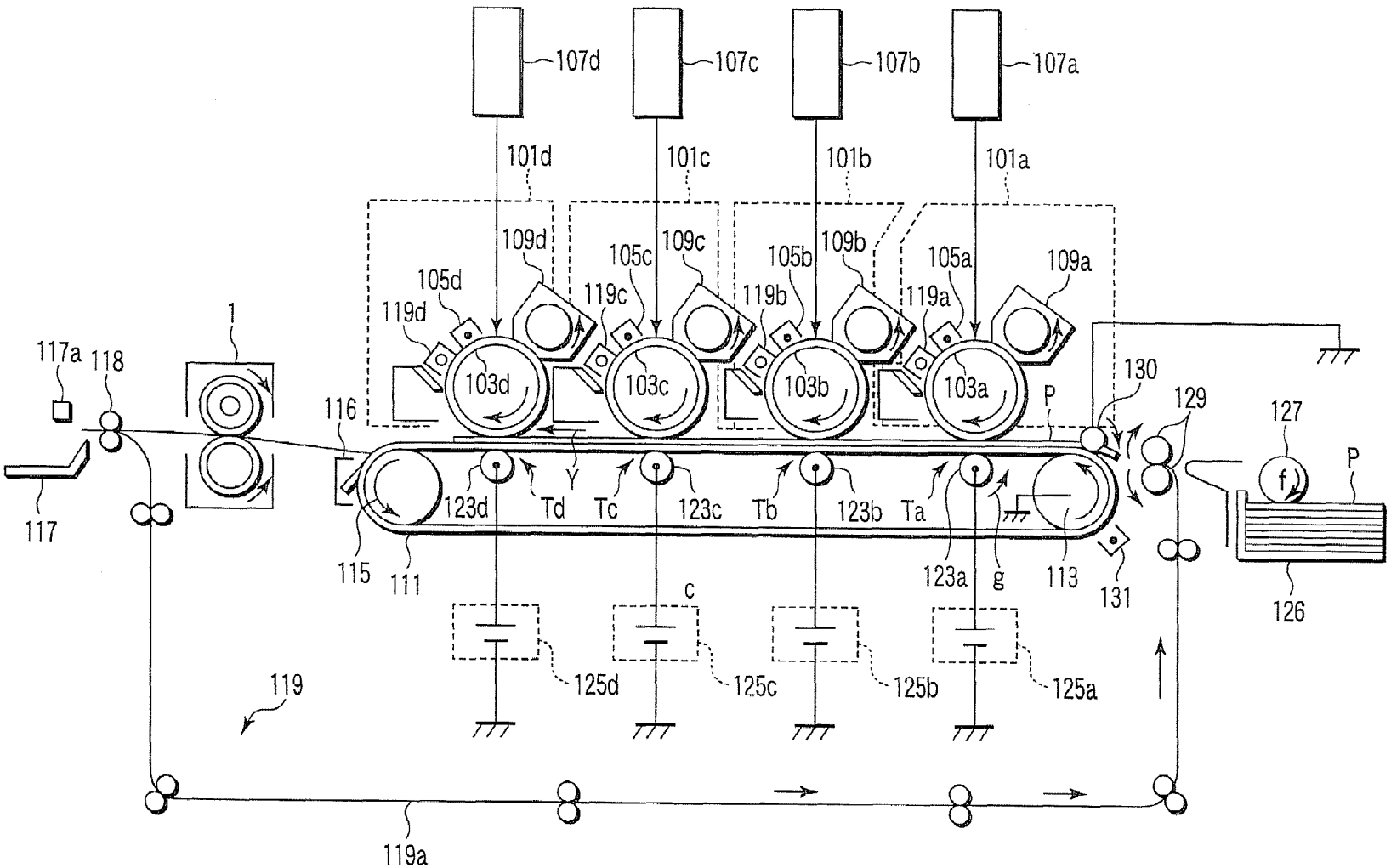
FIG. 1 is a schematic diagram explaining an example of an image processing apparatus according to an embodiment of the invention.

FIG. 1 is a sectional view of a 4-tandem color processing apparatus applicable to an image processing apparatus according to this embodiment.

As shown in FIG. 1, a 4-tandem color image processing apparatus includes process units 101*a*, 101*b* 101*c* and 101*d* as image processing means. The process units 101*a*-101*d* are image processing means for yellow (Y), magenta (M), cyan (C) and black (B) developers, respectively, and removable from a main body of the image processing apparatus. The process units 101*a*-101*d* have photoconductive drums 103*a*-103*d*, respectively, as image holding units (means). A developer image is formed in a photosensitive area on the outer peripheral surface of each photoconductive drum 103*a* to 103*d*. Namely, the photoconductive drums 103*a*-103*d* have a photosensitive area on the outer peripheral surface, where the potential is changed when exposed to light. In the photosensitive area, an image area and a non-image area with different potential are formed. An image holding unit may be a photosensitive belt instead of a photosensitive drum.

Near the process units 101*a*-101*d*, exposure units 107*a*, 107*b*, 107*c* and 107*d* are arranged for exposing laser beams with different intensity corresponding to image signals supplied from a not-shown image forming/processing control unit, on the photoconductive drums 103*a*-103*d*. The laser beams output from the exposure units 107*a*-107*d* can have predetermined light intensities corresponding to the density of an image. The exposure units 107*a*-107*d* may use LED instead of a laser.

On the side of the process unit 101*a*-101*d* opposite to the photoconductive drums 103*a*-103*d*, a conveying belt (conveying unit) 111 is provided as a means of conveying a sheet (transfer medium) P as an image forming medium. The conveying belt 111 conveys the sheet P in the direction of the arrow Y, and the sheet P comes in contact with the developer image formed on the photoconductive drums 103*a*-103*d*.

The conveying belt 111 has the length (width) almost equal to the length of the photoconductive drum 103*a*, in the direction orthogonal to the sheet P conveying direction Y (the depth direction in the drawing, or in the longitudinal direction of the photoconductive drum). The conveying belt 111 is an endless (seamless) belt, and carried and supported on a drive roller 115 rotating the conveying belt 111 at a predetermined speed and a driven roller 113. The distance from the drive roller 115 to the driven roller 113 is approximately 300 mm. The drive roller 115 and driven roller 113 are provided rotatably in the directions of the arrow i and j, respectively, in the drawing. As the drive roller 115 is rotated, the conveying belt 111 is moved, and the driven roller 113 is rotated. The conveying belt 111 is given sufficient tension not to slip by the weight applied to the outside direction of the driven roller 113.

Next, the process unit 101*a* will be explained.

The process unit 101*a*has a photoconductive drum 103*a*, an electric charger 105*a*, a developing unit 109*a*, and a discharging lamp 119*a*.

The photoconductive drum 103*a* has a photoconductor (photosensitive area) on the outer peripheral surface. When light is radiated to an area of the photoconductor, the potential of the area is changed, and this potential change is held as an electrostatic image for a fixed duration in time. The photoconductive drum 103*a* is shaped like a cylinder with a diameter of 30 mm, and provided rotatably in the direction of the arrow (clockwise) in the drawing. Around the photoconductive drum 103*a*, the discharging lamp 119*a*, electric charger 105*a* and developing unit 109*a* are arranged along the direction of rotation.

The electric charger 105*a* is provided opposite to the surface of the photoconductive drum 103*a*, and uniformly charges the photoconductive drum 103*a*. The electric charger 105*a* may be a corona wire, a contact roller, or contact blade. A laser from the exposure unit 107*a* is exposed in the area of the photoconductive drum 103*a* in the downstream of the electric charger 105*a* and in the upstream of the developing unit 109*a*. By this exposure of the exposing unit 107*a*, an electrostatic latent image is formed on the surface of the photoconductive drum 103*a* already charged by the electric charger 105*a*.

The developing unit 109*a* contains a yellow developer, and is place in the more downstream of the photoconductive drum 103*a* than the exposing position of the exposure unit 107*a*. The developing unit supplies the yellow developer to an image portion of the electrostatic latent image formed on the photoconductive drum 103*a* by the exposure unit 107*a*, and forms a developer image.

The discharging lamp 19*a* is placed in the downstream of the position where the photoconductive drum contacts the sheet P. The discharging lamp 19*a* discharges the surface electric charge of the photoconductive drum 3*a* by uniformly radiating light, after the developer image of the photoconductive drum 103*a* is transferred to the sheet P conveyed by the conveying belt 11.

This completes one cycle of image processing. In the next image processing process, the electric charger 105*a* uniformly charges the photoconductive drum 3*a* that is not yet charge.

On the conveying belt 111, the process units 101*b*, 101*c* and 101*d*, as well as 101*a*, are placed between the drive roller 115 and driven roller 113, along the sheet P conveying direction.

The process units 101*b*-101*d* have substantially the same configuration as the process unit 101*a*. Namely, the photoconductive drums 103*b*, 103*c* and 103*d* are provided at substantially the center of the process units. Electric chargers 105*b*, 105*c* and 105*d* are provided around the photoconductive drums. In the downstream of the exposing positions of the exposure units 107*b*, 107*c* and 107*d*, developing units 109*b*, 109*c* 109*d*, and discharging lamps 119*b*, 119*c* and 119*d* are provided. In these process units 101*b*-101*d*, the color of developer contained in the developing units 109*b*-109*d* is different. The developing unit 109*b* contains magenta developer, the developing unit 109*c* contains a cyan developer, and the developing unit 109*d* contains a black developer.

The sheet P conveyed by the conveying belt 111 sequentially contacts the photoconductive drums 103*a*-103*d*. Near the positions where the sheet P contacts the photoconductive drums 103*a*-103*d*, transfer units 123*a*, 123*b*, 123*c* and 123*d* are provided as transfer means corresponding to the photoconductive drums 103*a*-103*d*. Namely, the transfer units 123*a*-123*d* are provided contacting the backside of the conveying belt 111 under the corresponding photoconductive drums 103*a*-103*d*, and opposite to the process units 101*a*-101*d* through the conveying belt 111. At the positions where the process units 101*a*-101*d* are faced to the photoconductive drums 103*a*-103*d* through the conveying belt, transfer areas Ta, Tb, Tc and Td are defined for transfer of a toner image from the photoconductive drums 103*a*-103*d* to the sheet P.

The transfer unit 123*a* is connected to a direct current power supply 125*a* by a voltage application means. Likewise, the transfer units 123*b*, 123*c* and 123*d* are connected to direct current power supplies 125*b*, 125*c* and 125*d*, respectively. When the sheet P reaches the transfer area Ta, the transfer unit 123*a* is given a transfer bias voltage from the direct current power supply 125*a*. Then, a transfer electric field is formed between the transfer unit 123*a* and photoconductive drum 103*a*, and a yellow toner image on the photoconductive drum 13*a* is transferred to the sheet P according to the transfer electric field.

When the sheet P reaches the transfer area Tb, the direct current power supply 125*b* gives the transfer unit 123*b* a transfer bias voltage higher than that from the direction current power supply 125*a*. Then, a magenta toner image can be transferred onto the yellow toner image. When the sheet P reaches the transfer area Tc, the direct current power supply 125*c* gives the transfer unit 123*c* a transfer bias voltage higher than that from that from the direction current power supply 125*b*. Then a cyan toner image can be transferred onto the magenta toner image. When the sheet P reaches the transfer area Td, the direction current power supply 125*d* gives the transfer unit 123*d* a transfer bias voltage higher than that from the direction current power supply 125*c*. Then a black toner image can be transferred onto the cyan toner image. By giving a transfer unit a voltage higher than a transfer bias used for transferring an already transferred developer as described above, a next toner image can be transferred onto a previous toner image.

In FIG. 1, a paper supply cassette 126 containing the sheet P is provided on the front right side of the conveying belt 111. In the main body of the image processing apparatus, a pickup roller 27 to pickup the sheet P one by one from the paper supply cassette 126 is provided rotatably in the direction of the arrow f in the drawing. Between the pickup roller 127 and the conveying belt 111, a pair of registration rollers 129 is rotatably provided. The pair of registration rollers 129 supplies the sheet P onto the conveying belt 111 at a predetermined timing.

On the conveying belt 111, a metallic roller 130 is provided for electrostatically absorbing the sheet P on the surface of the conveying belt 111. The metallic roller 130 is grounded.

For charging the belt for absorbing the sheet, a corona charger 131 is provided under the driven roller 113 through the conveying belt 111, taking the driven roller 113 of the conveying belt 111 as a counter electrode.

On the front left side of the conveying belt 111 in FIG. 1, there are provided a fixing apparatus 1 for fixing the developer transferred by the process units 101*a*-101*d* onto the sheet P, and a paper eject tray 117 for ejecting the sheet P fixed by the fixing apparatus 1.

The fixing apparatus 1 is configured to supply predetermined heat and pressure to the sheet P holding a toner image, and fix a fused toner image to the sheet P.

The paper eject tray 117 receives the sheet P ejected from the fixing apparatus 1, through a paper eject roller 118, and stacks the image-fixed sheet P. A paper eject sensor 117*a* is provided near the paper eject tray 117, making it possible to detect whether the sheet P ejected from the fixing apparatus 1 has been ejected to the paper eject tray 117.

Under the conveying belt 111, a reversing mechanism 119 is provided to reverse the front/back side of the sheet P ejected from the fixing apparatus 1 to be printed on both sides, and conveys the sheet P up to the pair of registration rollers 129. Explaining in detail, the reversing mechanism 119 is configured to reverse rotation of the paper eject roller 118 after the sheet P is ejected from the fixing apparatus 1 by the paper eject roller, and transfer the sheet P to a reverse conveying mechanism 119*a* capable of conveying the sheet P up to the pair of registration roller 129 by conveying members. Thus, when printing on both sides of a sheet, the reversing mechanism 119 can reverse the sheet P with an image formed on one side, and conveys the sheet P to the entrance to the pair of registration rollers 129, to form an image on the other side.

Figure 2:
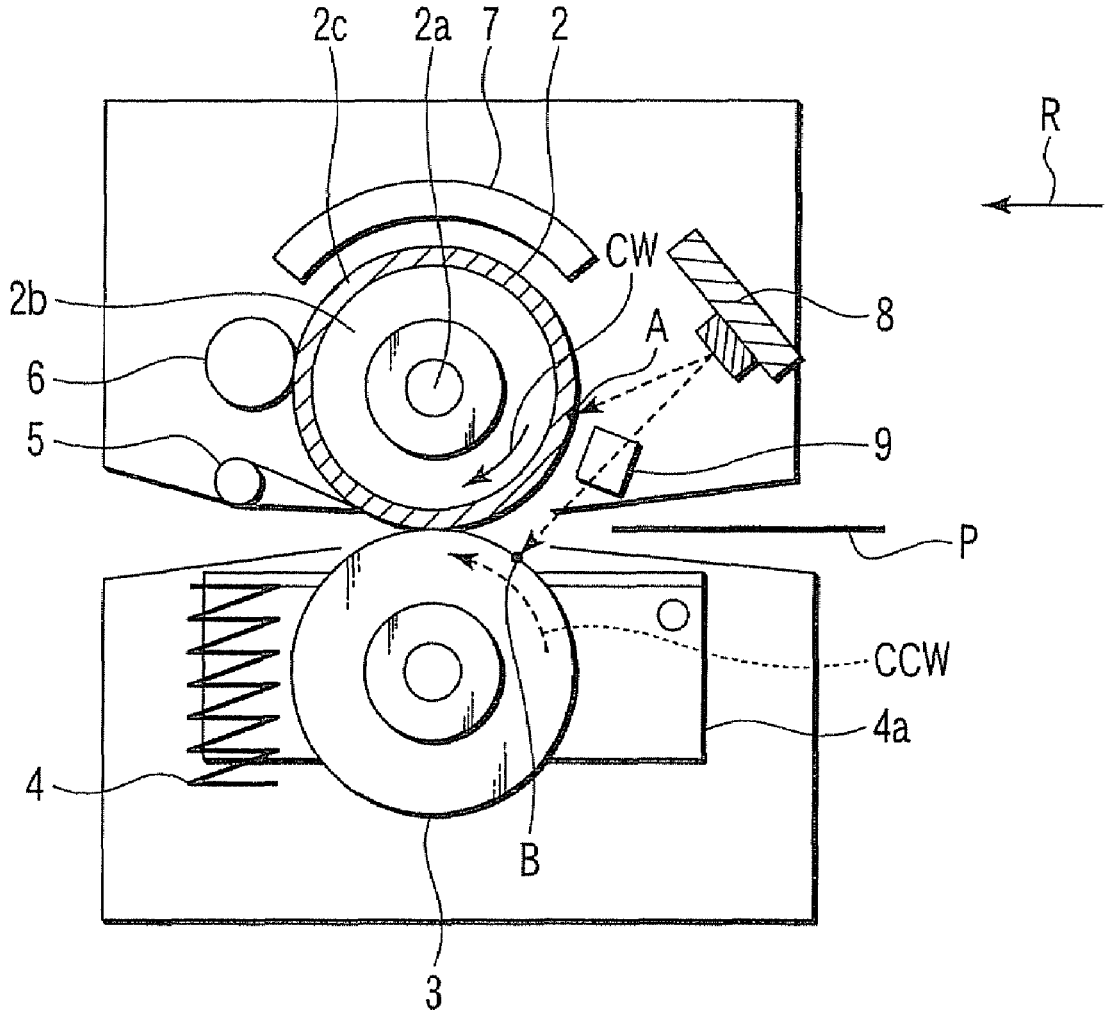
FIG. 2 is a schematic diagram explaining an example of a fixing apparatus used in the image processing apparatus shown in FIG. 1.
Figure 3:
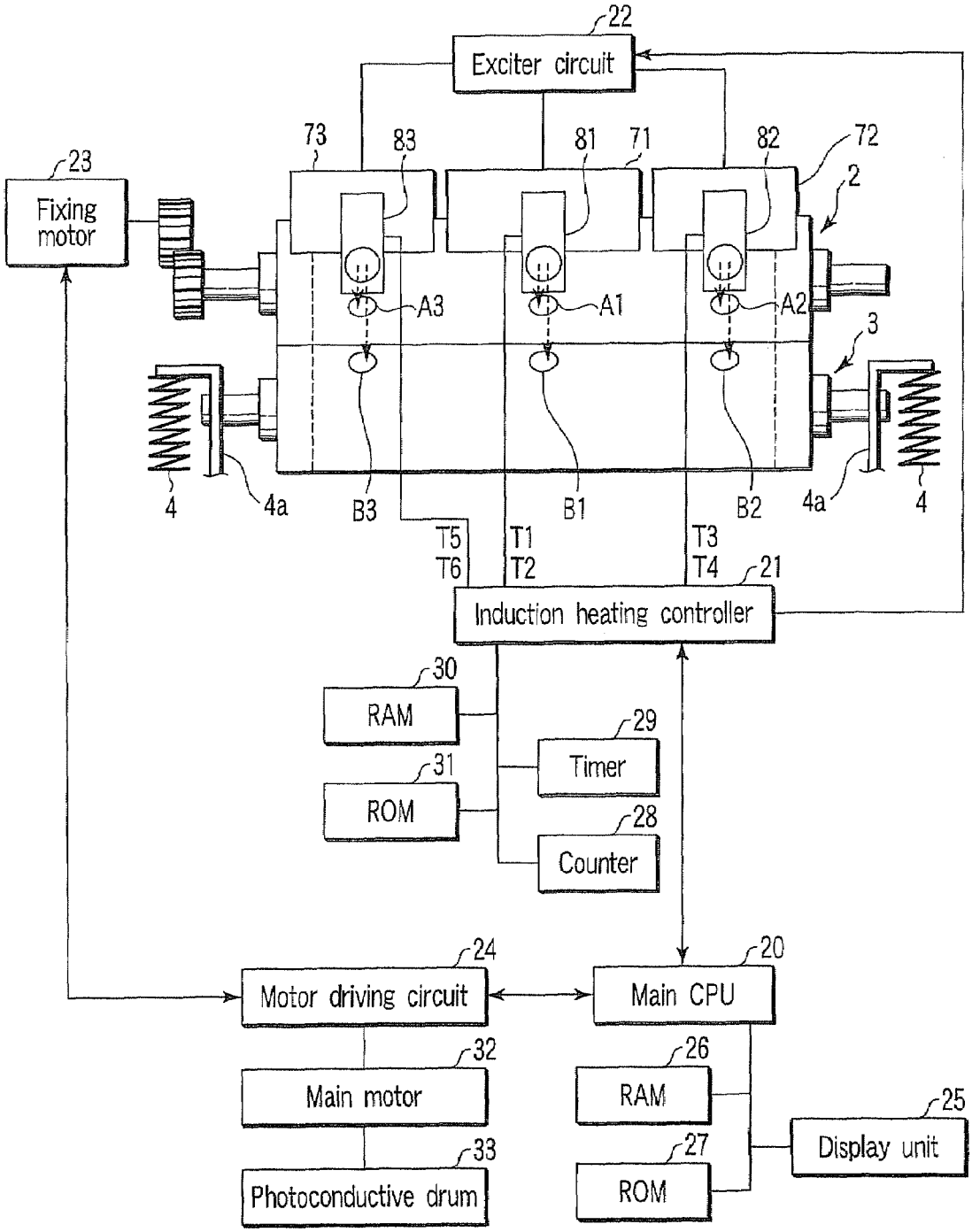
FIG. 3 is a block diagram explaining a control system of the fixing apparatus shown in FIG. 2.

FIG. 2 is a schematic diagram explaining an example of a fixing apparatus used in the image processing apparatus shown in FIG. 1. FIG. 3 is a block diagram explaining a control system of the fixing apparatus shown in FIG. 2.

As shown in FIG. 2, the fixing apparatus 1 has a heating roller (supplying heat means) 2, a pressurizing roller (pressurizing means) 3, a pressurizing spring 4, a peeling claw 5, a cleaning roller 6, a heater 7, a non-contact temperature detector 8, and a thermostat 9.

The heating roller 2 has a shaft 2*a* made of material having rigidity (hardness) not deformed by a predetermined pressure, an elastic layer (foamed rubber layer, sponge layer, silicon rubber layer) 2 provided sequentially around the shaft 2*a*, and a conductive layer (metallic conductive layer) 2*c*. Though not shown in this embodiment, it is preferable to form a solid rubber layer and a mold release layer composed of a thin film layer, such as a heat-resistant silicon rubber, on the outside of the metallic conductive layer 2*c*.

The metallic conductive layer 2*c* is made of conductive material (e.g. nickel, stainless steel, aluminum, copper, and aluminum-stainless steel composite material). The longitudinal length of the heating roller 2 is preferably 330 mm or more.

The foamed rubber layer 2*b* is formed with a thickness of preferably 5-10 mm, the metallic conductive layer 2*c* with a thickness of 10-200 μm, and solid rubber layer with a thickness of 100-200 μm, respectively. In this embodiment, the foamed rubber layer 2*b* is formed with a thickness of 5 mm, the metallic conductive layer 2*c* with a thickness of 40 μm, and solid rubber layer with a thickness of 200 μm, and mold release layer with a thickness of 30 μm, respectively. The diameter of the heating roller 2 is 50 mm.

The pressurizing roller 3 may be an elastic roller having a silicon rubber or fluorine rubber of predetermined-thickness formed around an axis of rotation of a predetermined diameter, or may be a roller having a metallic conductive layer and an elastic layer, like the heating roller 2.

The pressurizing spring 4 is pressed to the axial line of the heating roller 2 by a predetermined pressure. The pressurizing roller 3 is held substantially parallel to the axial line of the heating roller 2. The pressurizing spring 4 is given a predetermined pressure from both ends of the pressurizing roller 3 through a pressurizing support bracket 4a supporting the axis of the pressurizing roller 3, and can be parallel to the heating roller 2.

Therefore, a nip having a predetermined width is formed between the heating roller 2 and pressurizing roller 3.

The heating roller 2 is rotated in the direction of the arrow CW at substantially fixed speed by a fixing motor 23 explained later with reference to FIG. 3. The pressurizing roller 3 is pressed to the heating roller 2 by the pressurizing spring 4 at a fixed pressure. Therefore, the pressurizing roller 3 is rotated in the direction reverse to the rotating direction of the heating roller 2 at the position contacting the heating roller 2.

The peeling claw 5 is placed on the periphery of the heating roller 2, in the downstream of the direction of rotating the heating roller 2 by a nip coming in contact with both heating roller 2 and pressurizing roller 3, at a predetermined position close to the nip, and separates the sheet P passing through the nip from the heating roller 2. However, the present invention is not limited to this embodiment. For example, when much developer must be used to fix to a sheet as the case of forming a color image, a sheet is difficult to be separated from the heating roller, and two or more peeling claws 5 may be provided in this case. Contrarily, when a sheet is easily separated from the heating roller, a separation claw may not be used.

The cleaning roller 6 eliminates paper dust or toner offset on the surface of the heating roller 1.

The heater 7 is placed outside the heating roller 2, and has at least one heating coil (exciter coil), which is given a predetermined power and used to supply a predetermined magnetic field to the heating roller 2. When the heating coil is given a predetermined power from an exciter circuit 22 (refer to FIG. 3) and a magnetic field is generated, an eddy current flows in the metallic layer 2*c* of the heating roller, and the heating roller is heated by induction.

The non-contact temperature detector 8 is provided not contacting the surfaces of the heating roller 2 and pressurizing rollers 3, and detects the temperatures of the outer peripheral surfaces of the heating roller 2 and pressurizing roller 3. In this embodiment, the non-contact temperature detector 8 detects a temperature at a first detection position A located between the nip and an area immediately after being heated by the heater 7 over the outer peripheral surface of the heating roller 2, and a temperature at a second detection position in the pressurizing roller 3 immediately before the nip corresponding to the first detection position A in the peripheral direction of the heating roller 2. The non-contact temperature detector 8 in this embodiment may be configured to detect a temperature immediately after the exit of the heater 7 in the rotating direction of the heating roller 2, or may be configured to detect a temperature of the heating roller 2 in an area of the heater 7 facing to the exciter coil on the outer peripheral surface of the heating roller, or a temperature of the heating roller 2 immediately before the nip.

The thermostat 9 is used to detect abnormal heating caused by abnormal increase in the surface temperature of the heating roller 2, and interrupt the power supplied to the heating coil of the heater 7 when the abnormal heating occurs. Preferably, at least more than one thermostat 9 is provided in the proximity of the surface of the heating roller 2.

On the periphery of the pressurizing roller 3, there may be provided a peeling claw for peeling the sheet P from the pressurizing roller 3, and a cleaning roller for removing toner adhered to the peripheral surface of the pressurizing roller 3.

When the sheet P holding the toner T is passed through a nip formed between the heating roller 2 and the pressurizing roller 3, the toner T is fused and pressed to the sheet P, and a toner image is fixed.

FIG. 3 shows a block diagram explaining a control system of the fixing apparatus shown in FIG. 2. FIG. 3 also shows a schematic diagram of the fixing apparatus shown in FIG. 2, viewed from the direction of the arrow R.

As shown in FIG. 3, the heater 7 includes an induction heating coils 71, 72 and 73. The coil 71 is placed opposite to the central portion in the axial direction of the heating roller 2, and provides a magnetic field in the central portion of the heating roller 2. The coils 72 and 73 are placed in the end portions in the axial direction of the heating roller 2, and provide a magnetic field in the end portions of the heating roller 2.

The non-contact temperature detector 8 includes two or more non-contact temperature detection elements arranged in the longitudinal direction of the heating roller 2, for example, non-contact temperature detection elements 81, 82 and 83. Each of the non-contact temperature detection elements 81, 82 and 83 is a non-contact temperature detection element capable of detecting temperatures at more than one point by one element, and includes a thermopile temperature sensor (thermopile) capable of detecting a temperature by using infrared rays, and a thermistor to detect the atmospheric temperature near the thermopile.

The non-contact temperature detection element 81 detects a temperature T1 at a first detection position A1 that is a surface temperature of the heating roller 2 positioned between the coil 71 and nip, and a temperature T2 at a second detection position B1 that is a surface temperature of the pressurizing roller 3 positioned immediately before the nip, in the downstream of the rotating direction of the heating roller 2 at the first detection position A1.

The non-contact temperature detection element 82 detects a temperature T3 at a first detection position A2 that is a surface temperature of the heating roller 2 positioned between the coil 72 and nip, and a temperature T4 at a second detection position B2 that is a surface temperature of the pressurizing roller 3 positioned immediately before the nip, in the downstream of the rotating direction of the heating roller 2 at the first detection position A2.

The non-contact temperature detection element 83 detects a temperature T5 at a first detection position A3 that is a surface temperature of the heating roller 2 positioned between the coil 73 and nip, and a temperature T6 at a second detection position B3 that is a surface temperature of the pressurizing roller 3 positioned immediately before the nip, in the downstream of the rotating direction of the heating roller 2 at the first detection position A3.

As shown in FIG. 3, a main CPU 20 is connected to an induction heating controller 21, an exciter circuit 22, a fixing motor 23, a motor driving circuit 24, a display unit 25, a RAM 26, and a ROM 27.

The main CPU 20 comprehensively controls the fixing operation of the fixing apparatus 1.

The induction heating controller 21 controls the exciter circuit 22, so that the roller temperature information about the heating roller 2 detected by the non-contact temperature detection elements 81, 82 and 83 is input, and predetermined power based on this temperature information is supplied to the coils 71-73 of the induction heater 7. Explaining more specifically, the induction heating controller 21 controls the exciter circuit 22, so that the temperature of the heating roller 2 is increased to a fixing temperature necessary for fixing, uniformly in the axial direction, and maintained, based on the roller temperatures T1-T6 of the heating roller 2 output from the non-contact temperature detection elements 81, 82 and 83.

The induction heating controller 21 is connected to a counter 28, a timer 29, a RAM 30 and a ROM 31.

The ROM 31 stores predetermined set values used for the control by the induction heating controller 21. In this embodiment, the ROM 31 stores a table of preset values as fixing temperatures of the heating roller 2 and the pressurizing roller 3 used for a front side mode or a back side mode. As shown in FIG. 4 and FIG. 5, this table of preset values defines preset values corresponding to types of paper (ordinary paper, thick paper, thin paper, OHP resin sheet), types of printing (monochrome, color), or sizes of paper (A5, A4, A3, B5, B4). The preset values corresponding to the single-sided copying shown in FIGS. 4 and 5 are the preset values to be referenced in the front side mode described later, and the preset values corresponding to the double-sided copying are the preset values to be referenced in the back side mode described later.

The ROM 31 stores a first preset temperature as a preset value to start rotation of the heating roller 2 in the warming-up mode, a second preset temperature as a fixing temperature of the heating roller 2, a preset value to control or stop power supply to each coil according to a temperature difference between the heating roller 2 and the pressurizing roller 3, and a preset value to control power supply to each coil according to a temperature difference at the first detection positions A1-A3 in the heating roller 2. In this embodiment, the first preset temperature is preset to 110° C., and the second preset temperature is preset to 160° C.

The exciter circuit 22 supplies predetermined power to the coils 71-73 according to a control signal output from the induction heating controller 21. Then, a magnetic flux as a predetermined heating power is generated in the coils 71-73. This heating power is the largeness of a magnetic flux as a basis of generating an eddy current in the heating roller 2, and determined by the largeness of power supplied to the coils 71-73. For example, when the sheet P passes through the central area of the heating roller 2, a predetermined power to energize the coil 71 is output. When the sheet passes through the central area and end portion of the heating roller 2, a predetermined power 1300 W for example to energize the coils 71-73 is output.

The motor driving circuit 24 is connected to the fixing motor 23 which rotates the heating roller 2. The motor driving circuit may also be connected to a main motor 32 which rotates the photoconductive drum 103.

The display unit 25 displays a message to indicate status in the apparatus and a message to the user. For example, the display unit 25 displays a serviceman inspection mode, and informs the operator of the timing of cleaning/replacing the heating roller 2, cleaning of the non-contact temperature detector 8, paper jam, and abnormal rotation of the heating roller 2.

When the power is turned on, the induction heating controller 21 controls the exciter circuit 22, so that predetermined power is supplied to the coils 71-73 based on the roller temperatures T1-T6 of the heating roller 2 detected by the non-contact temperature detection elements 81, 82 and 83. A magnetic filed corresponding to the supplied power is generated in the coils, an eddy current flows in the metallic conductive layer 2*c* of the heating roller 2 receiving the magnetic field, and the metallic conductive layer 2*c* is heated. When the sheet P holding toner is passed between the heating roller 2 and the pressurizing roller 3, the fused toner is pressed to the sheet P, and an image is fixed.

Next, explanation will be given on a heating method of the fixing apparatus installed in the image processing apparatus shown in FIG. 1.

Figure 6:
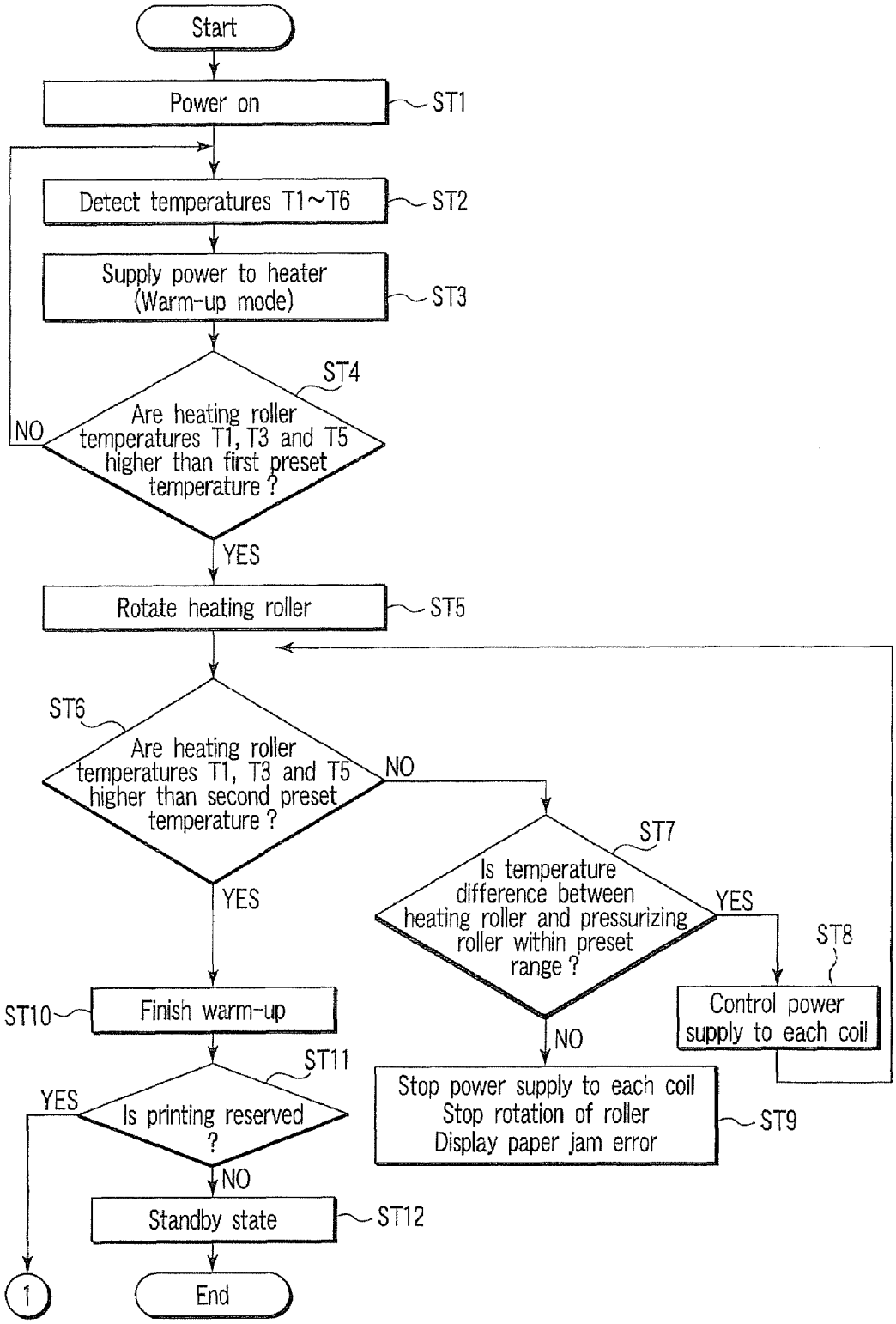
FIG. 6 is a flowchart explaining an example of heating method of the fixing apparatus shown in FIG. 2.

As shown in FIG. 6, when the power of the image processing apparatus is turned on (ST1), power is also supplied to the non-contact temperature detection elements 81-83. When the surface temperatures T1-T6 of the heating roller 2 are detected by the non-contact temperature detection elements 81-83 (ST2), predetermined power is supplied to the coils 71-73 of the heater 7 based on predetermined warming-up mode (ST3). A predetermined magnetic field is generated in the power supplied coils 71-73, the metallic layer 2*c* of the heating roller 2 is heated by induction, and the surface temperature of the heating roller 2 is increased. Then, the induction heating controller 21 judges whether the temperatures T1, T3 and T5 at the first detection positions A1, A2 and A3 of the heating roller 2 reach a first preset temperature (110° C.) (ST4). When the surface temperatures T1, T3 and T5 are higher than the first preset temperature (ST4-YES), the main CPU 20 instructs to drive the fixing motor 23, and the heating roller 2 is rotated (ST5).

When the heating roller 2 is rotated, the induction heating controller 21 judges whether the surface temperatures T1, T3 and T5 of the heating roller 2 reach a second preset temperature (160° C.) (ST6). When the surface temperatures T1, T3 and T5 are lower than the second preset temperature (ST6-NO), the induction heating controller 21 compares the temperatures at the first and second detection positions A1 and B1, for example, and judges whether the temperature difference between the heating roller 2 and the pressurizing roller 3 is within a preset range (ST7). When the temperature difference between the heating roller 2 and the pressurizing roller 3 is within a preset range (ST7-YES), the induction heating controller 21 controls power supply to the coils to a preset value in order to increase the surface temperature of the heating roller 2 to the fixing temperature (ST8). When the temperature difference between the heating roller 2 and the pressurizing roller 3 is over the preset range (ST7-NO), the induction heating controller 21 stops power supply to the coils, supposing that the heating roller 2 and the pressurizing roller 3 are not rotated. The main CPU 20 stops the fixing motor 23, and displays a paper jam error or abnormal rotation of the heating roller 2 in the display unit 25 (ST9).

Contrarily, when the surface temperatures T1, T3 and T5 of the heating roller 2 are higher than the second preset temperature in the step ST6 (ST6-YES), the induction heating controller 21 finishes the warming-up (ST10), and waits for a print reserve instruction (ST11). When the print reserve instruction is not given (ST11-NO), the apparatus goes in a standby state (ST12). When the print reserve instruction is given, the apparatus goes to the fixing mode shown in FIG. 7 (ST11-YES).

Figure 7:
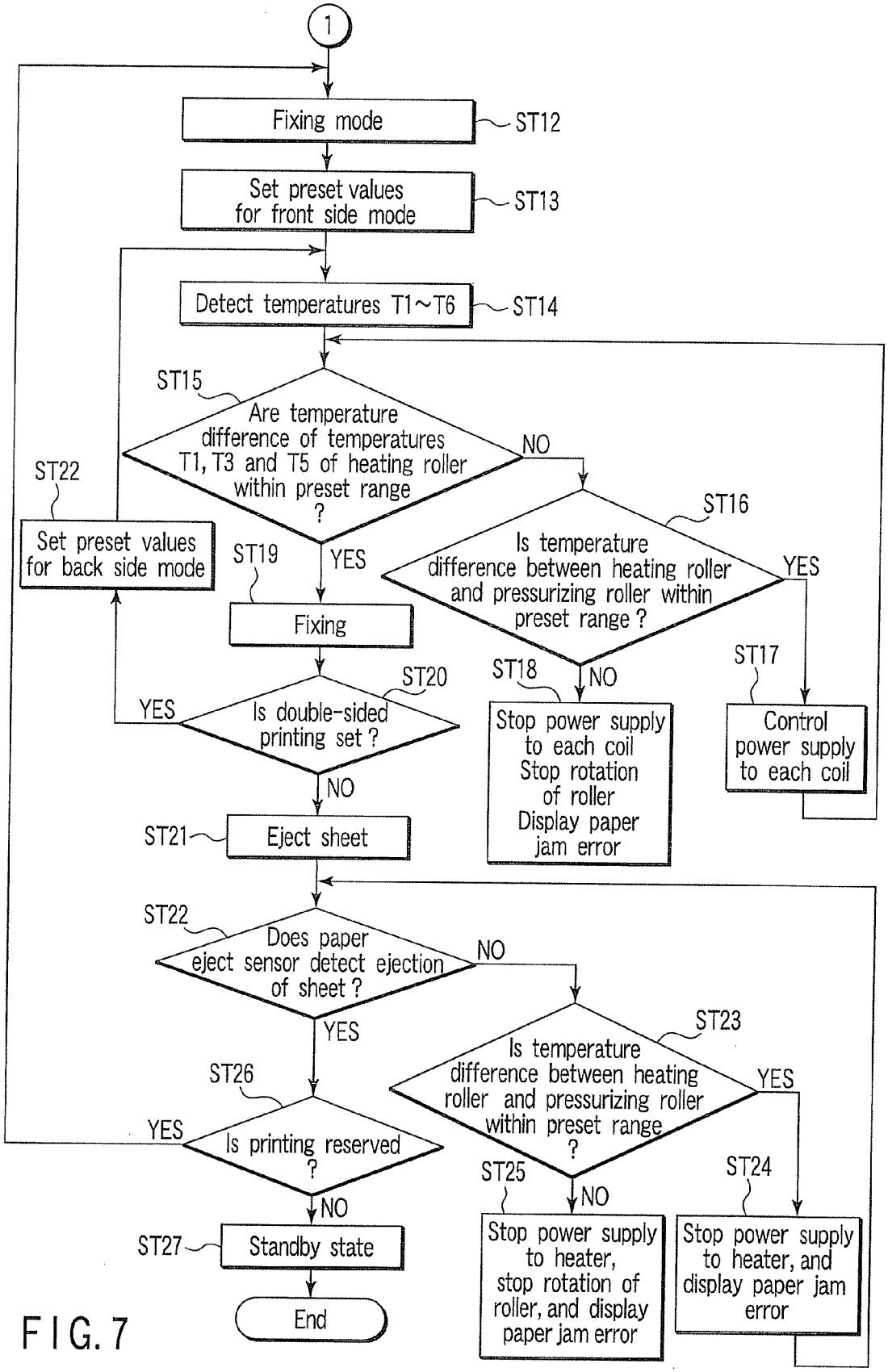
FIG. 7 is a flowchart explaining subsequent steps of the heating method shown in FIG. 6.

As shown in FIG. 7, when the apparatus goes to the fixing mode (ST12), the induction heating controller 21 controls the exciter circuit 22 based on the preset values of the front side mode by using the table of preset values shown in FIG. 4 and FIG. 5 (ST13). Namely, the second preset temperature as a fixing temperature is set to 170° C., and the fixing temperature of the pressurizing roller 3 is set to 117° C. as shown in FIG. 4 and FIG. 5 as a front side mode, according to the print reserve conditions (type, size and color of paper) instructed in the step ST11, for example, when the type and size of the paper are ordinary and A4, and the type of printing is color printing. Then, the non-contact temperature detection elements 81-83 detect the surface temperatures T1-T6 of the heating roller 2 (ST14), and the induction heating controller judges whether the temperature difference between these temperatures and the surface temperatures T1, T3 and T5 of the heating roller is within a preset range determined according to the second preset temperature set in the step ST13 (ST15). Therefore, the induction heating controller judges whether the surface temperatures T1, T3 and T5 of the heating roller are within the range of 167-173° C. defined by the second preset temperature 170±3° C. When the surface temperatures T1, T3 and T5 of the heating roller are not within the above preset range (ST15-NO), the induction heating controller 21 compares the temperatures at the first and second detection positions A1 and B1, and judges whether the temperature difference between the heating roller 2 and the pressurizing roller 3 is within the preset range based on the preset values for the front side mode set in the step ST13 (ST16). When the temperature difference between the heating roller 2 and the pressurizing roller 3 is within the preset range (ST16-YES), the induction heating controller controls power supply to the coils to a preset value in order to increase the surface temperature of the heating roller 2 to the fixing temperature (ST17). When the temperature difference between the heating roller 2 and the pressurizing roller 3 is over the preset range (ST16-NO), the induction heating controller 21 stops power supply to the coils, supposing that the heating roller 2 and the pressurizing roller 3 are not rotated. The main CPU 20 stops the fixing motor 23, and displays a paper jam error in the display unit 25 (ST18).

Contrarily, when the surface temperatures T1, T3 and T5 of the heating roller are within the above preset range (ST15-YES), the sheet P is conveyed between the heating roller 2 and the pressurizing roller 3, and the fixing operation is executed (ST19). Then, whether the double-sided printing is instructed in the print reserve in the step ST11 is judged (ST20). When the double-sided printing is not set (ST20-NO), the sheet P printed on one side is ejected to the paper eject tray 117 (ST21).

When double-sided printing is set in the step (ST20-TES), the induction heating controller 21 controls the exciter circuit 22 based on the preset values for the back side mode by using the table of preset values shown in FIG. 4 and FIG. 5 (ST22). Namely, the second preset temperature as a fixing temperature of the heating roller 2 is set to 165° C. and the fixing temperature of the pressurizing roller 3 is set to 105° C. according to the print reserve conditions (ordinary paper, color and A4 paper printing) instructed in the step ST11, for example. Then, the control step goes back to the step ST14, and the non-contact temperature detection elements 81-83 detect the surface temperatures T1-T6 of the heating roller 2 (ST14). The induction heating controller judges whether the temperature difference between these temperatures and the surface temperatures T1, T3 and T5 of the heating roller is within a preset range determined according to the second preset temperature set in the step ST22 (ST15). Namely, the induction heating controller judges whether the surface temperatures T1, T3 and T5 of the heating roller are within the range of 162-168° C. defined by the second preset temperature 165±3° C. When the surface temperatures T1, T3 and T5 of the heating roller are not within the above preset range (ST15-NO), the induction heating controller 21 judges whether the temperature difference between the heating roller 2 and the pressurizing roller 3 is within the preset range (ST16). When the temperature difference between the heating roller 2 and the pressurizing roller 3 is within the preset range set in the step ST22 (ST16-YES), the induction heating controller controls power supply to the coils to a preset (ST17). When the temperature difference between the heating roller 2 and the pressing roller 3 is over the preset range (ST16-NO), the induction heating controller 21 stops power supply to the coils (ST18).

Contrarily, when the surface temperatures T1, T3 and T5 of the heating roller are within the above preset range (ST15-YES), the fixing operation is executed (ST19). Then, the sheet P is printed on both sides. Therefore, the main CPU 20 judges that the double-sided printing is finished in the step ST20 (ST20-NO), and ejects the sheet P printed on both sides to the paper eject tray 117 (ST21).

Then, the paper eject sensor 117*a* judges whether the sheet P is ejected to the paper eject tray 117 (ST22). When the ejection of sheet P is not confirmed (ST22-NO), the induction heating controller 21 judges whether the temperature difference between the heating roller 2 and the pressurizing roller 3 is within the preset range (ST23). When the temperature difference between the heating roller 2 and the pressurizing roller 3 is within the preset range (ST23-YES), the induction heating controller controls power supply to the coils to a preset (ST24). When the temperature difference between the heating roller 2 and the pressurizing roller 3 is over the preset range (ST23-NO), the induction heating controller 21 stops power supply to the coils (ST25).

Contrarily, when the paper eject sensor 117*a* confirms the ejection of sheet P (ST22-YES), whether printing is reserved is judged (ST26). When printing is reserved (ST26-YES), the control step goes back to the step ST12, and the operation mode is switched to the fixing mode (ST26-YES). When printing is not reserved (ST26-NO), the apparatus goes into a standby state (ST27).

As explained above, in the double-sided printing, by setting the fixing temperature in the back side mode to lower than in the front side mode and using two modes properly, a high-temperature offset can be prevented when the sheet P is heated again in the back side mode immediately after being printed on the front side, and good image fixing can be realized. Particularly, when a cardboard is printed in full-color printing, thermal capacity is large when printing the front side, and the back side is printed while the paper temperature is still high. The effect of properly using the front side mode and back side mode is high.

In the fixing apparatus 1 configured to heat the heating roller 2 by using induction heating of the heater 7, as in this embodiment, responsivity of the heating roller 2 to be heated is high. Therefore, the effect of properly using the front side mode and back side mode is high as described above.

Further, as the heater 7 is configured to be capable of switching power supply to the coils 71-73, it can be prevented that an A4 sheet is continuously passed through the area corresponding to the central coil 71 and a temperature is increased at the end portions of the heating roller corresponding to the end coils 72 and 73 where the sheet is not passed through, compared with the central area. This prevents deterioration of the surface of the heating roller 2 caused by excessive heating, and uneven quality of an image fixed to the sheet can be prevented. As the heating roller 2 is prevented from being excessively heated, the apparatus becomes more safety and energy-saving.

As the temperature difference between the heating roller 2 and the pressurizing roller 3 is compared with a preset range and an apparatus error is detected, even if the shaft 2*a* and elastic layer 2*b* of the heating roller 2 are separated and the outer periphery of the heating roller 2 is not rotated, though the heating roller 2 is rotated by the fixing motor, abnormal rotation of the heating roller 2 can be detected.

When a set temperature is decreased in the back side mode in this embodiment, power supplied to the coils 71-73 is decreased. However, the invention is not limited to this configuration. For example, the invention may be configured to decrease the thermal capacity of the heating roller 2 by changing the frequency of the current supplied to the coils 71-73, or configured to shut off the power supplied to the coils 71-73 for a certain period.

The non-contact temperature detection elements 81-83 may be configured to detect the surface temperature of the heating roller 2 immediately before the nip, or to detect the temperature of the sheet P conveyed to the nip, in addition to detect the temperatures at the first and second detection positions A and B.

Further, when the surface temperature of the heating roller 2 does not reach the first preset temperature within a predetermined time in the step ST4 in the warming-up mode shown in FIG. 6, the invention may be configured to temporarily increase the output power to the coils 71-73.

EMBODIMENT 2

Another example of the fixing apparatus 1 shown in FIG. 2 will be explained with reference to FIGS. 8-11.

Figure 8:
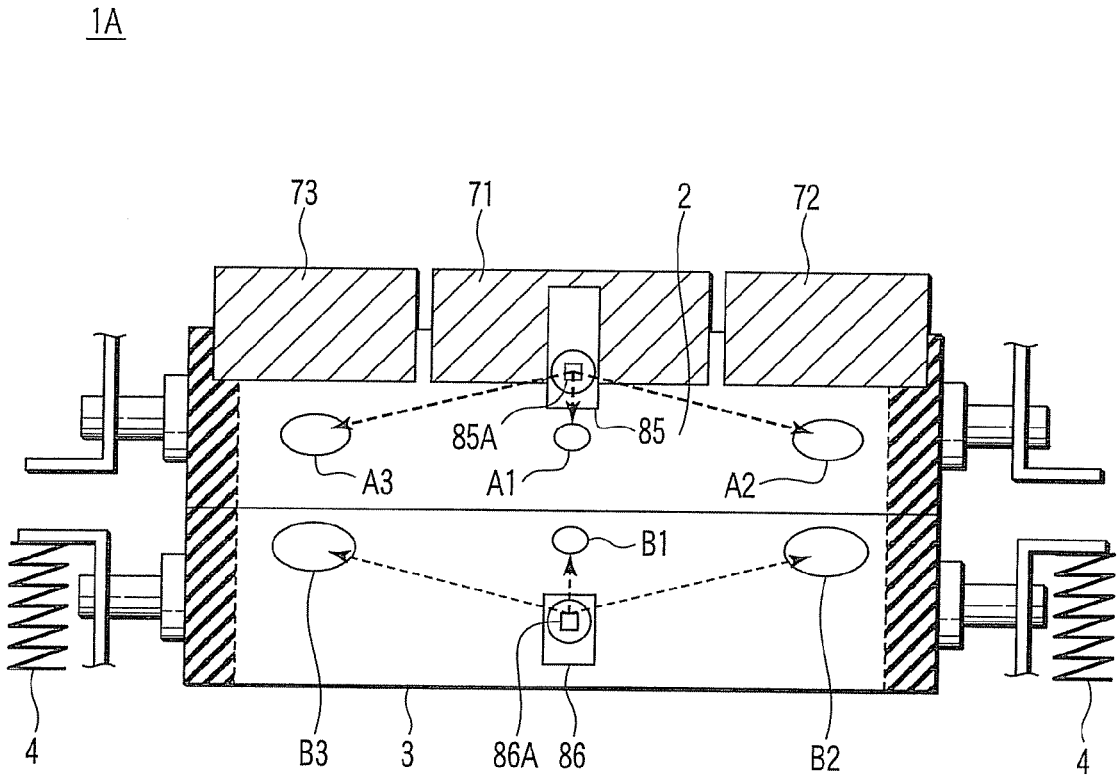
FIG. 8 is a schematic diagram showing another example of the fixing apparatus shown in FIG. 1.

As shown in FIG. 8, the fixing apparatus 1A applicable to this embodiment has a heating roller 2, a pressurizing roller 3, a pressurizing spring 4, a central coil 71, end coils 72 and 73, and non-contact temperature detectors 85 and 86. Detailed explanation will be omitted for the components given the same reference numerals as those in the first embodiment. Thought not shown, the fixing apparatus 1A according to this embodiment has a peeling claw 5, a cleaning roller 6, a heater 7, and a thermostat 9.

The non-contact temperature detector 85 is a non-contact temperature detection element capable of detecting temperatures at more than one point by one element, and includes a thermopile temperature sensor (thermopile) capable of detecting a temperature by using infrared rays, and a thermistor to detect the atmospheric temperature near the thermopile. The non-contact temperature detector 85 is placed at the middle of the longitudinal direction of the heating roller 2, and can detect temperatures of two more areas in the longitudinal direction of the heating roller 2, preferably detect temperatures of two or more areas located on the same line. The non-contact temperature detector 85 can detect a temperature T1 at a first detection position A1 located between the coil 71 and nip, a temperature T3 at a first detection position A2 located between the coil 72 and nip, and a temperature T5 at a first detection position A3 located between the coil 73 and nip. The non-contact temperature detector 85 is provided in the proximity of the first detection position A1, and separated the same distance from the first detection positions A2 and A3. The non-contact temperature detector 85 is configured to have a wider detection range for the far first detection positions A2 and A3, compared with a range for the near first detection position A1. As the non-contact temperature detector 85 is separated the same distance from the first detection positions A2 and A3, the first detection positions A2 and A3 have the same detection range. In this embodiment, the non-contact temperature detector 85 has a predetermined mask 85A to define a detection range for the first detection positions A1-A3.

The non-contact temperature detector 86 is a non-contact temperature detection element capable of detecting temperatures at more than one point by one element, and includes a thermopile temperature sensor (thermopile) capable of detecting a temperature by using infrared rays, and a thermistor to detect the atmospheric temperature near the thermopile. The non-contact temperature detector 86 is placed at the middle of the longitudinal direction of the pressurizing roller 3, and can detect temperatures of two or more areas in the longitudinal direction of the pressurizing roller 3, preferably detect temperatures of two or more areas located on the same line. The non-contact temperature detector 86 can detect a temperature T2 at a second detection position B1 located immediately before the nip, in the downstream of the rotating direction of the heating roller 2 at the first detection position A1, a temperature T4 at a second detection position B2 located immediately before the nip, in the downstream of the rotating direction of the heating roller 2 at the first detection position A2, and a temperature T6 at a second detection position B3 located immediately before the nip, in the downstream of the rotating direction of the heating roller 2 at the first detection position A3. The non-contact temperature detector 86 is provided in the proximity of the second detection position B1, and separated the same distance from the second detection positions B2 and B3. The non-contact temperature detector 86 is configured to have a wider detection range for the far second detection positions B2 and B3, compared with a range for the near second detection position B1. As the non-contact temperature detector 85 is separated the same distance from the first detection positions A2 and A3, the first detection positions A2 and A3 have the same detection range. In this embodiment, the non-contact temperature detector 86 has a predetermined mask 86A to define a detection range for the second detection positions B1-B3.

As described above, the non-contact temperature detectors 85 and 86 have a wide detection range for far detection positions compared with a range for near detection positions. Therefore, even for a detection position far from the thermopile detection position of the non-contact temperature detectors 85 and 86, an infrared energy can be increased by enlarging a detection range. Namely, even if the thermopile detection position of the non-contact temperature detectors 85 and 86 and the detection position in the heating roller 2 or the pressurizing roller 3 are different, an infrared energy can be detected at a certain level regardless of whether the distance is increased or decreased, by enlarging the detection range for far detection positions. Therefore, the first detection positions A1-A3 can receive a sufficient infrared energy for detection of temperatures, and an exact temperature can be detected. This solves the problem that a temperature lower than the actual temperature is detected because of failing to receive sufficient infrared energy.

In this embodiment, a detection range is enlarged in proportion to the distance from the thermopile detection position of the non-contact temperature detectors 85 and 86 to the detection position in the heating roller 2 or the pressurizing roller 3. The temperatures T1-T6 detected by the non-contact temperature detectors 85 and 86 are applicable to the heating method explained with reference to FIGS. 4-7.

Figure 9:
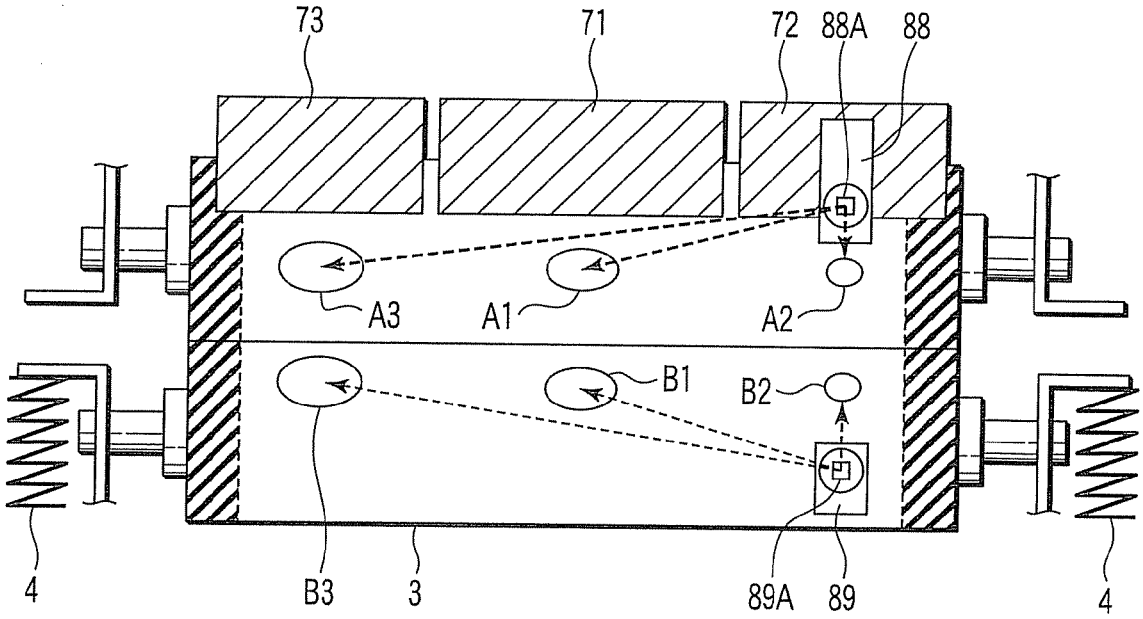
FIG. 9 is a schematic diagram showing another example of the fixing apparatus shown in FIG. 8.

This embodiment may be configured like the fixing apparatus 1B shown in FIG. 9.

As shown in FIG. 9, a non-contact temperature detector 88 is a non-contact temperature detection element capable of detecting temperatures at more than one point by one element, and includes a thermopile temperature sensor (thermopile) capable of detecting a temperature by using infrared rays, and a thermistor to detect the atmospheric temperature near the thermopile. The non-contact temperature detector 88 is placed at both ends of the heating roller 2, and can detect temperatures of two or more areas in the longitudinal direction of the heating roller 2, preferably detect temperatures of two or more areas located on the same line. The non-contact temperature detector 88 can detect a temperature T1 at a first detection position A1 located between the coil 71 and nip, a temperature T3 at a first detection position A2 located between the coil 72 and nip, and a temperature T5 at a first detection position A3 located between the coil 73 and nip. The non-contact temperature detector 88 is provided in the proximity of the first detection position A2, and separated farthest from the first detection position A3. The non-contact temperature detector 88 has a different detection range according to a distance from a detection position: narrowest at the nearest first detection position A2, and widest at the farthest first detection position A3. In this embodiment, the non-contact temperature detector 88 has a predetermined mask 88A to define a detection range for the first detection positions A1-A3. The mask is preferably made of material such as resin with small radiation energy.

The non-contact temperature detector 89 is a non-contact temperature detection element capable of detecting temperatures at more than one point by one element, and includes a thermopile temperature sensor (thermopile) capable of detecting a temperature by using infrared rays, and a thermistor to detect the atmospheric temperature near the thermopile. The non-contact temperature detector 89 is placed at the end of the pressurizing roller 3, and can detect temperatures of two or more areas in the longitudinal direction of the pressurizing roller 3, preferably detect temperatures of two or more areas located on the same line. The non-contact temperature detector 89 can detect a temperature T2 at a second detection position B1 located immediately before the nip, in the downstream of the rotating direction of the heating roller 2 at the first detection position A1, a temperature T4 at a second detection position B2 located immediately before the nip, in the downstream of the rotating direction of the heating roller 2 at the first detection position A2, and a temperature T6 at a second detection position B3 located immediately before the nip, in the downstream of the rotating direction of the heating roller 2 at the first detection position A3. The non-contact temperature detector 89 is provided in the proximity of the second detection position B2, and separated farthest from the second detection position B3. The non-contact temperature detector 89 has a different detection range according to a distance from a detection position: narrowest at the nearest first detection position B2, and widest at the farthest first detection position B3. In this embodiment, the non-contact temperature detector 89 has a predetermined mask 89A to define a detection range for the second detection positions B1-B3.

Figure 10:
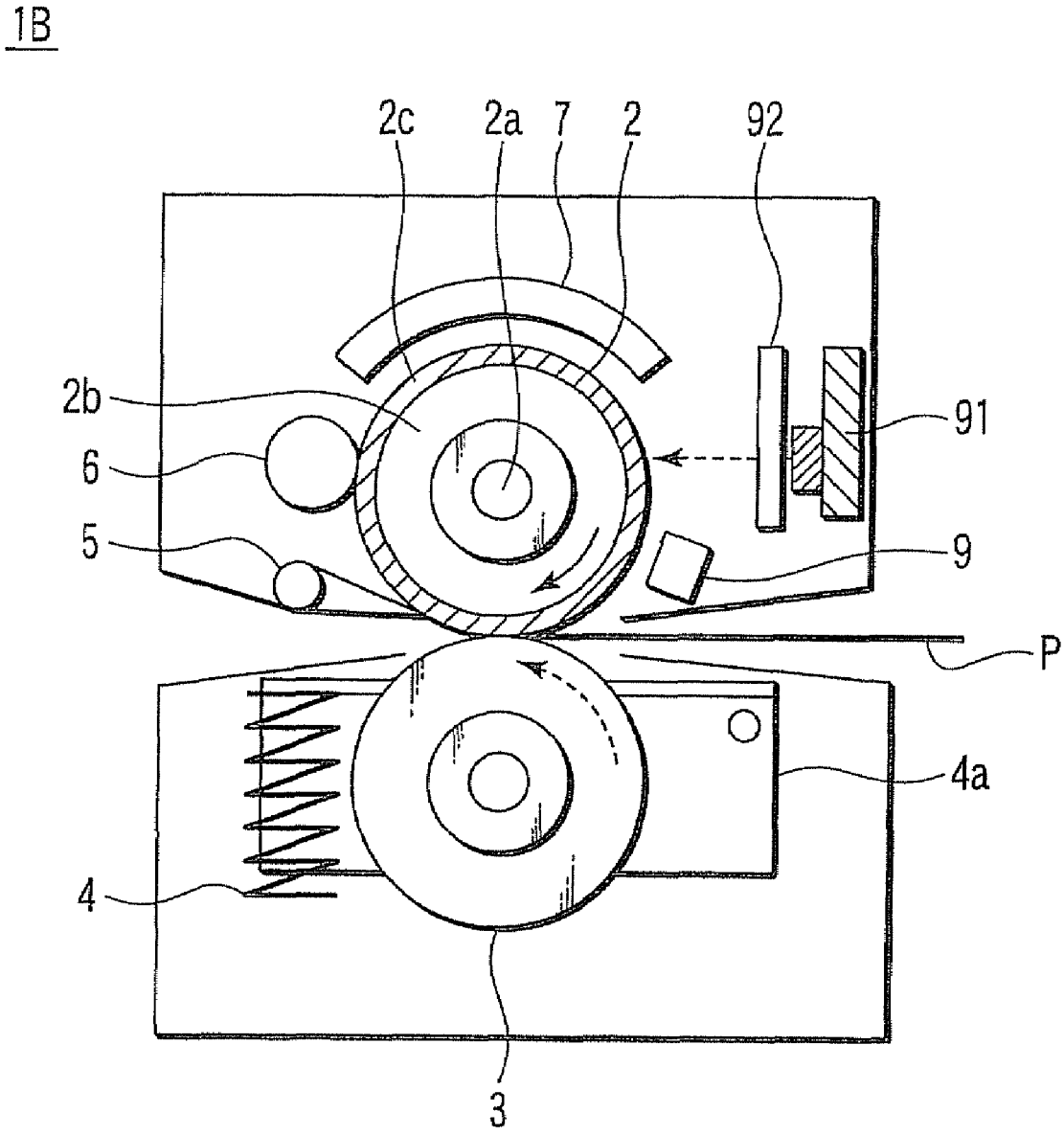
FIG. 10 is a schematic diagram showing still another example of the fixing apparatus shown in FIG. 1.
Figure 11:
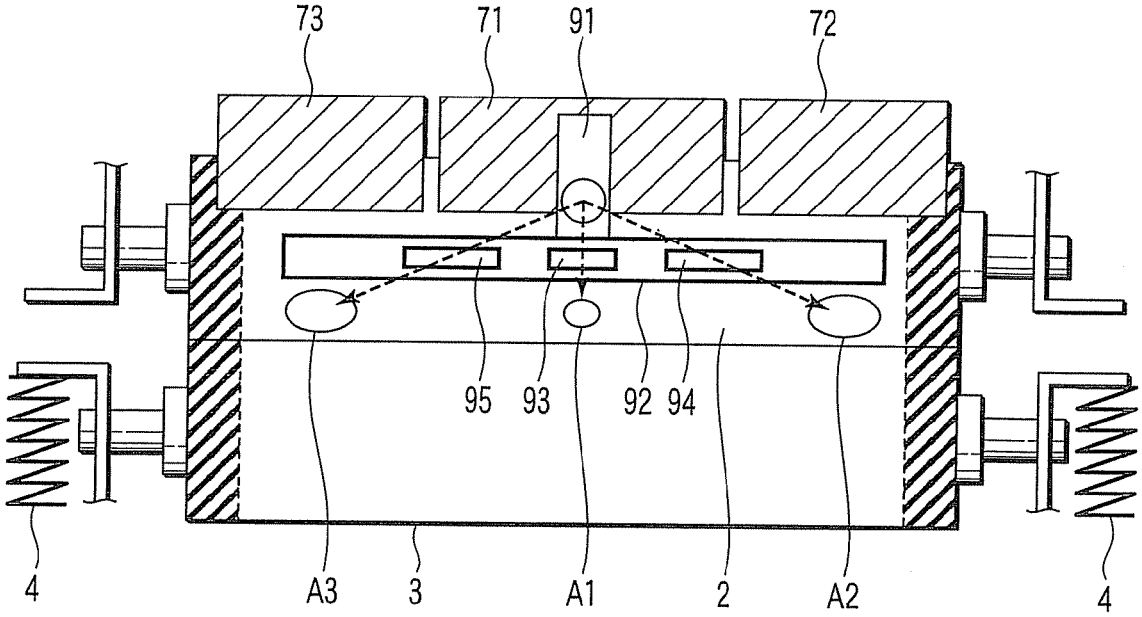
FIG. 11 is a schematic diagram of the fixing apparatus shown in FIG. 10, viewed from another angle.

The fixing apparatus 1B applicable to this embodiment may be configured as shown in FIGS. 10 and 11.

As shown in FIG. 10, the fixing apparatus 1B has a heating roller 2, a pressurizing roller 3, a pressurizing spring 4, a peeling claw 5, a cleaning roller 6, a heater 7, a thermostat 9, a non-contact temperature detector 91, and a detection range adjustment member 92. Explaining more specifically, as shown in FIG. 11, the heater 7 includes a central coil 71 and end coils 72 and 73. The heater 7 includes detection positions A1-A3 to detect surface temperatures T1, T3 and T5 of the heating roller heated by the coils 71-73, respectively. Detailed explanation will be omitted for the components given the same reference numerals as those in the first embodiment.

As shown in FIG. 11, the non-contact temperature detector 91 is placed at the middle of the longitudinal direction of the heating roller 2, and can detect temperatures at two or more areas in the longitudinal direction of the heating roller 2, preferably detect temperatures of two or more areas located on the same line. The non-contact temperature detector 91 can detect a temperature T1 at a first detection position Al located between the coil 71 and nip, a temperature T3 at a first detection position A2 located between the coil 72 and nip, and a temperature T5 at a first detection position A3 located between the coil 73 and nip. The non-contact temperature detector 91 is provided in the proximity of the first detection position A1, and separated the same distance from the first detection positions A2 and A3. The non-contact temperature detector 91 is configured to have a wider detection range for the far first detection positions A2 and A3, compared with a range for the near first detection position A1. As the non-contact temperature detector 85 is separated the same distance from the first detection positions A2 and A3, the first detection positions A2 and A3 have the same detection range.

The detection range adjustment member 92 is placed between the non-contact temperature detector 91 and the detection position A1 in the heating roller 2, as shown in FIGS. 10 and 11, and limits the amount of infrared energy received by the non-contact temperature detector 91. Explaining in detail, the detection range adjustment member 92 has a first slit 93 to restrict the infrared energy radiated from the first detection position A1 and received by the non-contact temperature detector 91, a second slit 94 to restrict the infrared energy received by the non-contact temperature detector 91 so that the infrared energy from the first detection position A2 becomes equal to the infrared energy from the first slit 93, and a third slit 95 to restrict the infrared energy received by the non-contact temperature detector 91 so that the infrared energy from the first detection position A3 becomes equal to the infrared energy from the first slit 93. Namely, the detection range adjustment member 92 has slits (openings) 93-95 so that the infrared energies radiated from the detection positions Al-A3 and received by the non-contact temperature detector 91 become equal.

As described above, the non-contact temperature detector 91 is defined by the detection range adjustment member 92 to have a wider detection range for far detection positions, compared with a range for near detection positions. Therefore, even for a detection position far from the thermopile detection position of the non-contact temperature detector 91, infrared energy can be increased by enlarging a detection range.

The present invention is not limited to the embodiment described above. The invention may be embodied by changing constituent elements without departing from its spirit or essential characteristics. The invention may be embodied in various forms by properly combining constituent elements disclosed in the embodiment described above. For example, some constituent elements may be deleted from the constituent elements shown in the embodiments. Constituent elements may be combined over different embodiments.

For example, in this embodiment, a preset value (second preset value) as a fixing temperature of the heating roller 2 is explained as 160° C. The invention is not limited to this value. The setting may be changed according to the apparatus structure, the melting point of developer to be used, etc. The preset value is different according to the type, size and thickness of a recording medium to be used. For example, when a recording medium is thick, set a temperature higher than an ordinary preset value.

Further, in this embodiment, a pressure is applied from the pressurizing roller 3 to the heating roller 2. The invention is not limited to this structure. The invention may be configured to apply a pressure from the heating roller 2 to the pressurizing roller 3.

Further, a contact-type temperature detection element may be used in combination with the non-contact temperature detector 8.

The non-contact temperature detector 8 may be either a binocular non-contact temperature detection element to detect two or more detection points by one element as in this embodiment, or a monocular non-contact temperature detection element provided for each detection point.

In this embodiment, the heater 7 include the exciter coils 71-73 and the exciter circuit 22, and heats the heating roller 2 by induction. The invention is not limited to this configuration. The heating roller 2 may be heated by a halogen lamp, for example.

In the warming-up method explained in FIG. 5, when a temperature is not increased to a preset value within a predetermined warming-up time, the power supplied to the exciter coil of the heater 7 may be temporarily increased.

What is claimed is:

1. An image processing apparatus comprising:

an image holding unit which forms an electrostatic latent image;

a developing unit which provides a developer to the image holding unit, and changes the electrostatic latent image into a developer image;

a transfer unit which transfers the developer formed in the image holding unit to a developer holding medium;

a fixing unit apparatus including:

a heating roller for supplying heat to the developer holding medium holding the developer image;

a pressurizing roller which comes in contact with the heating roller;

a heater having heating members for heating the heating roller; and a non-contact temperature detector which detects a first temperature of the heating roller in an area between a position heated by the heater and a position to contact the pressurizing roller with heating the heater, and a second temperature of the pressurizing roller in an area near a part to contact the heating roller;

a reversing mechanism which reverses the developer holding medium ejected from the fixing unit, and returns to the image holding unit so that the back side of the developer holding medium with the developer image fixed is faced to the image holding unit;

a memory which stores preset values of the first and second temperatures for a front side mode for fixing the developer image on one side, and preset values of the first and second temperatures for a back side mode for fixing the developer image on the other side of the developer holding medium reversed by the reversing mechanism, according to conditions of the developer holding medium; and a controller which heats the heating roller according to the back side mode, when an image is formed on the other side of the developer holding medium reversed by the reversing mechanism.

2. The image processing apparatus according to claim 1, wherein the preset values of the first and second temperatures are lower in the back side mode compared with the front side mode, when the conditions of the developer holding medium are the same.

3. The image processing apparatus according to claim 1, further comprising;

the heater includes coils for providing the heating roller with a predetermined magnetic field, and heating the heating roller by induction heating.

4. The image processing apparatus according to claim 3, wherein the coils are arranged at a central area and both end portions of the heating roller.

5. The image processing apparatus according to claim 3, wherein the non-contact temperature detector includes non-contact temperature detection elements for detecting the first and second temperatures of the areas corresponding to the coils.

6. The image processing apparatus according to claim 1, wherein the controller detects abnormal rotation of the heating roller, based on a difference between the first and second temperatures detected by the non-contact temperature detector.

7. The image processing apparatus according to claim 1, wherein the conditions of the developer holding medium are limited by size and type, and full-color printing or monochrome printing.

8. The image processing apparatus according to claim 1, wherein the non-contact temperature detector includes a first non-contact temperature detection element for detecting the first temperature from detection positions in a longitudinal direction of the heating roller, and a second non-contact temperature detection element for detecting the second temperature from detection positions in a longitudinal direction of the pressurizing roller, and the first and second non-contact temperature detection elements are configured to have a wider detection range for far detection positions, compared with a range for near detection positions.

9. The image processing apparatus according to claim 1, further comprising;

the non-contact temperature detector further includes a non-contact temperature detection element for detecting the first temperature from detection positions in a longitudinal direction of the heating roller, and a detection range adjustment member which is placed between the non-contact temperature detection element and the heating roller, and has openings to set a detection range wider for far detection positions, compared with a range for near detection positions.

10. An image processing apparatus comprising:

an image holding means which forms an electrostatic latent image;

a developing means which provides a developer to the image holding means, and changes the electrostatic latent image into a developer image;

a transfer means which transfers the developer formed in the image holding means to a developer holding medium;

a fixing means including:

a supplying heat means for supplying heat to a developer holding medium holding a developer image;

a pressurizing means which comes in contact with the supplying heat means;

a heating means having heating members for heating the supplying heat means; and a non-contact temperature detection means which detects a first temperature of the supplying heat means in an area between a position heated by the heating means and a position to contact the pressurizing means with heating the heating means, and a second temperature of the pressurizing means in an area near a part to contact the supplying heat means;

a reversing means which reverses the developer holding medium ejected from the fixing means, and returns the medium to the image holding means so that the back side of the developer holding medium with the developer image fixed is faced to the image holding means;

a memory means which stores preset values of the first and second temperatures for a front side mode for fixing the developer image on one side, and preset values of the first and second temperatures for a back side mode for fixing the developer image on the other side of the developer holding medium reversed by the reversing means, according to conditions of the developer holding medium; and a control means which heats the supplying heat means according to the back side mode, when an image is formed on the other side of the developer holding medium reversed by the reversing means.

11. The image processing apparatus according to claim 10, wherein the preset values of the first and second temperatures are lower in the back side mode compared with the front side mode, when the conditions of the developer holding medium are the same.

12. The image processing apparatus according to claim 10, further comprising;

the heating means includes coils for providing the supplying heat means with a predetermined magnetic field, and heating the supplying heat means by induction heating.

13. The image processing apparatus according to claim 12, wherein the coils are arranged at a central area and both end portions of the supplying heat means.

14. The image processing apparatus according to claim 12, wherein the non-contact temperature detection means includes non-contact temperature detection elements for detecting the first and second temperatures of the areas corresponding to the coils.

15. The image processing apparatus according to claim 10, wherein the control means detects abnormal rotation of the supplying heat means, based on a difference between the first and second temperatures detected by the non-contact temperature detection means.

16. The image processing apparatus according to claim 10, wherein the conditions of the developer holding medium are limited by size and type, and full-color printing or monochrome printing.

17. The image processing apparatus according to claim 10, wherein the non-contact temperature detection means includes a first non-contact temperature detection element for detecting the first temperature from detection positions in a longitudinal direction of the supplying heat means, and a second non-contact temperature detection element for detecting the second temperature from detection positions in a longitudinal direction of the pressurizing roller, and the first and second non-contact temperature detection elements are configured to have a wider detection range for far detection positions, compared with a range for near detection positions.

18. The image processing apparatus according to claim 10, further comprising;

the non-contact temperature detection means further includes a non-contact temperature detection element for detecting the first temperature from detection positions in a longitudinal direction of the heating roller, and a detection range adjustment means which is placed between the non-contact temperature element and the heating roller, and has openings to set a detection range wider for far detection positions, compared with a range for near detection positions.

19. A fixing apparatus comprising:

a heating roller for providing heat to a developer holding medium holding a developer image;

a pressurizing roller which comes in contact with the heating roller;

a heater having heating members for heating the heating roller;

a non-contact temperature detector which includes a first non-contact temperature detection element for detecting a first temperature of the heating roller in an area between a position heated by the heater and a position to contact the pressurizing roller with heating the heater, from detection positions in the longitudinal direction of the heating roller; and a first detection range adjustment member which is placed between the first non-contact temperature detection element and the heating roller, and has openings to set a detection range wider for far detection positions, compared with a range for near detection positions.

20. The image processing apparatus according to claim 19, wherein the non-contact temperature detector further includes a second non-contact temperature detection element for detecting a second temperature of the pressurizing roller in an area near a part to come in contact with the heating roller, from detection positions in the longitudinal direction of the pressurizing roller, and a second detection range adjustment means which is placed between the second non-contact temperature detection element and the pressurizing roller, and has openings to set a detection range wider for far detection positions, compared with a range for near detection positions.

* * * * *